United States Patent [19]

Lobakk

[11] Patent Number: 4,905,492

[45] Date of Patent: Mar. 6, 1990

[54] METHOD AND DEVICE FOR FORMING A TRANSVERSE COLLAR ON THE END OF A METAL PIPE

[75] Inventor: Sverre Lobakk, Oslo, Norway

[73] Assignee: GS-Hydro Oy, Vantaa, Finland

[21] Appl. No.: 157,941

[22] Filed: Feb. 19, 1988

[30] Foreign Application Priority Data

Feb. 24, 1987 [FI] Finland ..... 870799

[51] Int. Cl.[4] ..... B21D 19/04

[52] U.S. Cl. ..... 72/117; 72/125; 72/126

[58] Field of Search ..... 72/69, 82, 83, 111, 72/115, 116, 117, 120, 123, 125

[56] References Cited

U.S. PATENT DOCUMENTS

| | | | |
|---|---|---|---|
| 1,765,704 | 6/1930 | Schultis | 72/117 |
| 2,004,313 | 6/1935 | Crockett | 72/126 |
| 2,124,743 | 7/1938 | McMahon | 72/117 |
| 2,370,089 | 2/1945 | Swyers | 72/125 |
| 3,477,265 | 11/1969 | Szitar, Jr. | 72/117 |

FOREIGN PATENT DOCUMENTS

| | | | |
|---|---|---|---|
| 130424 | 7/1985 | Japan | 72/117 |

*Primary Examiner*—Lowell A. Larson

*Attorney, Agent, or Firm*—Dennison, Meserole, Pollack & Scheiner

[57] ABSTRACT

A method and device are disclosed for forming the end of a metal pipe into a collar substantially perpendicular to the longitudinal axis of the pipe. The method involves spreading the pipe end into a position perpendicular to the longitudinal direction of the pipe in two or more stages. The device includes an auxiliary head of conic form for spreading the pipe end into a collar substantially perpendicular to the longitudinal axis of the pipe, the auxiliary head being mounted in the device after the pipe end has been spread in a first stage to an angle differing from 0° relative to the longitudinal direction of the pipe. The auxiliary head is so arranged that the working surface of the auxiliary head, when pressed against the pipe end, is substantially perpendicular to the longitudinal direction of the pipe.

4 Claims, 2 Drawing Sheets

METHOD AND DEVICE FOR FORMING A TRANSVERSE COLLAR ON THE END OF A METAL PIPE

FIELD OF THE INVENTION

The present invention relates to a method and device for forming a collar at the end of a metal pipe at an angle substantially perpendicular to the longitudinal axis of the pipe.

DESCRIPTION OF THE PRIOR ART

Many ways are known of making butted joints between metal pipes. One way is that proposed in Finnish Patent No. 70080, in which each pipe end to be joined is first formed into a cone-shaped collar disposed at an angle of approximately 37° to the longitudinal axis of the pipe. The collar can be produced, for example, using a machine provided with a rotating cone for expanding the pipe end, the cone being generally movable in a lengthwise direction relative to the pipe. The machine includes a frame and a chuck attached to the frame by an axle and rotated by an actuator incorporated in the device. The chuck is so arranged that it always remains aligned with that part of the pipe which is to be collared and accommodates an expanding cone for spreading the pipe end from 0° to an angle depending on the angle of taper of the cone and the angle between the axle of the cone and the longitudinal direction of the pipe. The cone is eccentrically and freely rotatably mounted on that end of the chuck which points away from the frame, so that the axial direction of the cone differs from that of the pipe. Jaws are provided for holding the pipe during the collaring operation so that the pipe end to be collared is brought close to the expanding cone. The device is also provided with means for adjusting the distance between the pipe end and the cone.

An insert of a corresponding form is placed inside and between the pipe ends thus formed and the ends are pressed together by means of flanges placed on the pipe ends behind the collars and tightened, e.g. by bolts and screws. Such a joint is good in itself and can withstand high pressures, such as those commonly used in hydraulic systems, but it is also expensive, especially because the insert required must be manufactured to great precision. For this reason, this type of joint is not favoured in low-pressure systems.

In another type of flanged joint in common use, the pipe end is provided with a collar which is essentially perpendicular to the longitudinal axis of the pipe. This can be made in many ways, e.g. by welding a separate piece provided with such a collar onto the pipe end. However, this type of joint is also expensive and time-consuming to produce.

Finnish Patent Application No. 791685 proposes a device for collaring a pipe end via plastic shaping. The device uses a mandrel which is rolled on the inside of the pipe and simultaneously tilted outwardly against the pipe wall. The mandrel is controlled by a carriage which is fitted on a support provided with arched guide rails in such a manner that, in order to tilt the mandrel, the carriage can be moved on the guide rails relative to its support by power means connected to the carriage. To produce the rolling movement of the mandrel, the carriage support is attached to a revolving body. In addition, the mandrel is so attached to the carriage that it is radially adjustable.

With such a device it is naturally possible to shape plastically the pipe end, so as to produce a collar at right angles to the longitudinal axis of the pipe. However, it has the disadvantages of being complex, heavy and expensive. Because of its enormous size and weight, the device cannot be taken to the site where the pipes are to be installed.

BRIEF SUMMARY OF THE INVENTION

An object of the present invention is to provide a method and device for collaring a pipe end for flange jointing in such manner that the collar is substantially perpendicular to the longitudinal axis of the pipe and can be quickly produced by means of a simple and light device.

Accordingly, one aspect of the invention provides a method for forming the end of a metal pipe into an annular collar substantially perpendicular to the longitudinal axis of the pipe, which comprises carrying out the operation of expanding the pipe and so as to produce a collar perpendicular to the longitudinal axis of the pipe in two or more stages.

In a preferred embodiment of the method of the invention, the expansion operation is carried out in two stages, the first stage consisting in expanding the pipe end to an angle of 35–40° using a method known per se, while in the second stage the pipe end is expanded further to an angle of approximately 90° relative to the longitudinal axis of the pipe.

In another preferred embodiment of the method of the invention, the pipe is collared in the first stage with a device known per se using an expanding cone, whereupon an auxiliary head is placed on top of the cone or the cone is replaced by a different expanding head, so as to carry out the second stage of the expansion operation.

Another aspect of the invention provides a device for forming the end of a metal pipe to produce a collar substantially perpendicular to the longitudinal direction of the pipe, which device comprises a frame, a chuck attached to the frame by an axle and rotated by an actuator incorporated in the device, the chuck being so arranged that it always remains aligned with that part of the pipe which is to be collared and accommodates an expanding cone for spreading the pipe end in a first stage from 0° to an angle depending on the angle of taper of the cone and the angle between the axle of the cone and the longitudinal direction of the pipe, the cone being eccentrically and freely rotatably mounted on that end of the chuck which points away from the frame, so that the axial direction of the cone differs from that of the pipe, jaws for holding the pipe during the collaring operation so that the pipe end to be collared is brought close to the expanding cone, the device being provided with means for adjusting the distance between the pipe end and the cone, and an auxiliary head of conic form for spreading the pipe end in a second stage into a collar essentially perpendicular to the longitudinal axis of the pipe, said auxiliary head being mounted in the device after the pipe end has been spread by said expanding cone in said first stage, the head being so arranged that its working surface, when pressed against the pipe end, is substantially perpendicular to the longitudinal direction of the pipe.

A preferred embodiment of the device of the invention includes an auxiliary head so designed that it can be mounted on top of the expanding cone, the interior surface of the auxiliary head having essentially the same form as the outer surface of the expanding cone, so that the auxiliary head can be held in place by frictional force.

In another preferred embodiment of the device of the invention, the auxiliary head consists of a different expanding cone, which is mounted in place of the first cone after the pipe end has been spread in the first stage to an angle differing from 0° relative to the longitudinal direction of the pipe.

The invention offers several advantages over solutions previously known in the art. The most important advantages are the small size and portability of the device, which makes it easy to transport it to the site of installation of the pipes, and the ease and speed of operation.

BRIEF DESCRIPTION OF THE DRAWINGS

Further objects, features and advantages of the invention will become apparent to those skilled in the art from the following description thereof when taken in conjunction with the accompanying drawings, in which.

DESCRIPTION OF THE PREFERRED EMBODIMENTS

Figure 1:
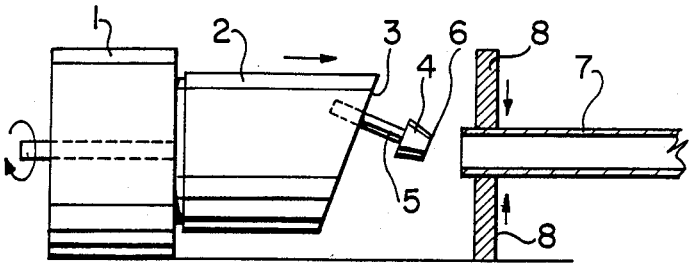
FIGS. 1 to 4 are diagrammatic, partly sectional views of a collaring machine showing different phases of the collaring operation.

FIG. 1 shows part of a collaring machine known per se which can be used in the method of the invention. The machine comprises a frame 1 and a chuck 2 supported by a shaft attached to the frame, the chuck being rotatable by an actuator. In this embodiment, the end of the chuck pointing away from the frame is of an oblique form. In existing collaring machines used for making collars at an angle of approximately 37° relative to the longitudinal direction of the pipe, this oblique end forms an angle of approximately 15°–20° to the vertical plane. The oblique end is provided with a hole placed eccentrically and accommodating a shaft 5 of an expanding cone 4, the shaft being so mounted in the hole by means of bearings that it is freely rotatable and substantially perpendicular to the chuck end surface. The angle of taper of the expanding cone may vary depending on the desired angle of the collar and the other angles referred to. The angle of the finished collar is determined by the angle between the longitudinal axis of pipe 7 and working surface 6 of the expanding cone 4.

The collaring device also comprises holding jaws 8, between which the pipe 7 is firmly secured during the collaring operation. The length of the collar produced depends on how far the end of the pipe 7 protrudes past the jaws 8.

Figure 2:
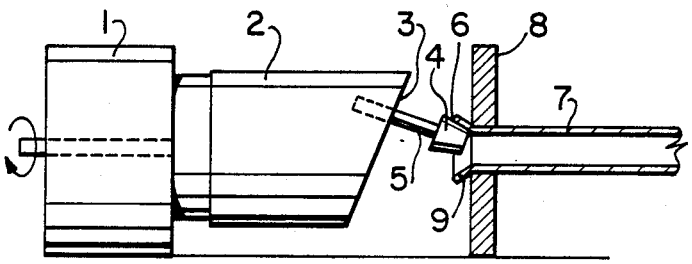

In the first stage, the pipe 7 is secured in place by means of the jaws 8. FIG. 2 shows the second stage, in which the rotating chuck 2 moves axially towards the pipe 7. The working surface 6 of the expanding cone 4 is now pressed against the pipe end, which thus begins to be expanded by virtue of the rotation and axial thrust of the chuck, a collar 9 being thus formed at the pipe end. During the collaring operation, the expanding cone 4 rolls freely along the interior surface of the pipe 7, without sliding friction.

When the expanding cone 4, driven by the chuck 2, has advanced far enough into the pipe and the desired collar has been produced, the chuck stops advancing and begins to withdraw, pulling the expanding cone 4 clear from the collar 9.

Figure 3:
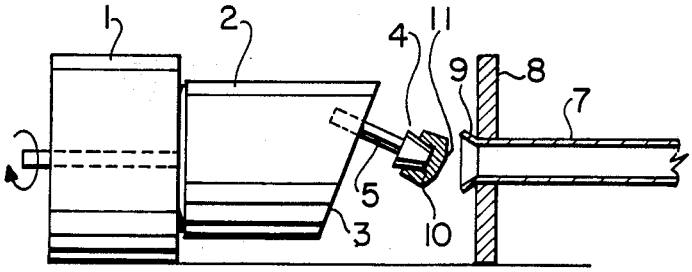

The next phase of the operation is illustrated in FIG. 3. As shown, an auxiliary head 10 is placed over the expanding cone 4, the angle of taper of the auxiliary head being larger than that of the expanding cone 4. That part of working surface 11 of the auxiliary head 10 which is pressed against the collar 9 is substantially perpendicular to the longitudinal direction of the pipe. No other restrictions are imposed on the auxiliary head, which means that in other respects it may be designed in almost any form.

Figure 4:
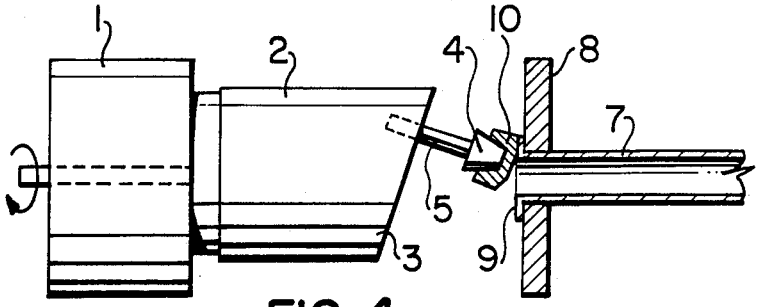

FIG. 4 shows a phase of the operation where the chuck 2 has again advanced towards the pipe 7. The auxiliary head is pressed against the collar 9, expanding it further in the same manner as before. Once the collar has been forced into an angle of 90° relative to the longitudinal axis of the pipe, the chuck 2 is again withdrawn.

The above description relates to a device in which the chuck and the expanding cone move towards the pipe. However, the device may equally well be designed so that the expanding cone is immovable in the axial direction of the pipe while the members holding the pipe in place move towards the expanding cone.

Figure 5:
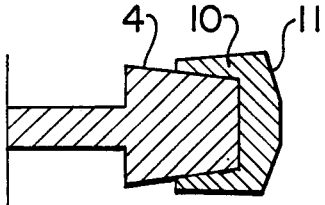
FIGS. 5 to 8 are sectional views showing different embodiments of auxiliary head for a collaring machine.
Figure 6:
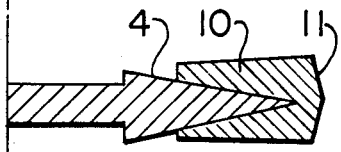

FIGS. 5 to 8 show different possible forms of the auxiliary head. In FIGS. 5 and 6, the auxiliary head 10 consists of an additional member, provided with a working surface 11, which is placed over the expanding cone 4. The auxiliary head is held in place on the expanding cone by virtue of friction, provided that the two pieces are fitted together with sufficient precision. It should be noted that the joint between these two pieces is not subjected to any axial forces tending to dislodge the auxiliary head and only to insignificant tangential dislodging forces, because the cone is freely rotatable in the chuck 2. FIG. 5 shows a truncated expanding cone 4. This kind of cone is used to make collars in pipes with a large diameter. Expanding cones like the one in FIG. 6 are used for collaring pipes with a small diameter.

Figure 7:
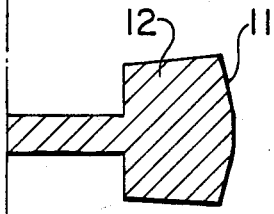
Figure 8:
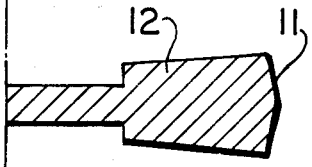

FIGS. 7 and 8 depict another important embodiment of the invention. The auxiliary head need not necessarily be of the kind which is placed on top of the expanding cone, but it may instead be a different expanding cone 12, which is mounted in the chuck after the first stage of the collaring operation has been finished. This type of auxiliary head 12 may also be of any form, although only two different possibilities are shown in FIGS. 7 and 8. It should also be noted that it is only for reasons of convenience that the cones in FIGS. 5 to 8 are shown in a horizontal position. As stated above, in an actual collaring machine the cones are placed in a position where the working surface 11 is essentially perpendicular to the longitudinal direction of the pipe 7 to be collared.

The pipes to be collared may be made of various metals. The materials most commonly used in hydraulic piping are steel, e.g. St 37, and stainless austenitic steel, e.g. AISI 316. The main point is that the material should permit cold forming and bending of the pipe.

It will be obvious to persons skilled in the art that the invention is not restricted to the above embodiments, but that it may instead be varied within the scope of the following claims. For example, the angle of the collar produced in the first stage is not particularly critical. The main idea is to produce a collar at an angle differing from 0° to make it possible to expand the pipe end further in the second stage to the final 90° angle, which can not be done directly on a straight pipe, using this type of collaring machine.

I claim:

1. A method for forming the end of a metal pipe into an annular collar substantially perpendicular to the longitudinal axis of the pipe, which comprises carrying out the operation of expanding the pipe end so as to produce a collar perpendicular to the longitudinal axis of the pipe in two or more stages; including the steps of positioning an expanding cone device beyond the pipe end for free rotation about its own axis and for introduction into the pipe end, orienting the cone device with its axis eccentrically of the axis of the pipe and inclined toward the pipe end and pipe axis, effecting a relative rotation between the cone device and the pipe about the longitudinal axis of the pipe and introducing the cone device into the pipe end for initial collaring of the pipe end in the first stage, withdrawing the cone device from the pipe end, placing a similarly oriented auxiliary head on said cone device and circumferentially supporting said head by said cone device for free rotation therewith about the axis of said cone device, introducing the auxiliary head into the pipe end to further collar the pipe end in the second stage, and effecting a relative rotation between the cone device, with the supported auxiliary head, and the pipe about the longitudinal axis of the pipe.

2. A method according to claim 1, wherein the expansion operation is carried out in two stages, the first stage essentially consisting of expanding the pipe end to an angle of 35–40°, while in the second stage the pipe end is expanded further to an angle of approximately 90° relative to the longitudinal axis of the pipe.

3. A device for forming the end of a metal pipe to produce a collar substantially perpendicular to the longitudinal direction of the pipe, which device comprises a frame, a chuck attended to the frame by an axle and rotated on an axis defined by the axle by an actuator incorporated in the device, the chuck being so arrangd that its axis always remains aligned with the axis of the pipe and that part of the pipe which is to be collared, the chuck mounting an expanding cone for rotation therewith about the axis of the chuck and pipe, and for spreading the pipe end in a first stage from 0° to an angle depending on the angle of taper of the cone and the angle between the axis of the cone and the axis of the pipe, the cone being freely rotatable about its axis and eccentrically on that end of the chuck which points away from the frame, so that the axial direction of the cone differs from that of the pipe, jaws for holding the pipe during the collaring operation so that the pipe end to be collared is brought close to the expanding cone, the deice being provided with means for adjusting the distance between the pipe end and the cone, and, an auxiliary head of conic form for spreading the pipe end in a second stage into a collar essentially perpendicular to the longitudinal axis of the pipe, said auxiliary head being circumferentially supported on said cone device for rotation therewith about the axis of the cone device and the axis of the pipe after the pipe end has been spread by said expanding cone in said first stage, the head being so arranged that its working surface, when pressed against the pipe end, is substantially perpendicular to the longitudinal direction of the pipe.

4. A device according to claim 3, wherein the auxiliary head so so designed that it can be mounted on top of said expanding cone, the interior surface of the auxiliary head having essentially the same form as the outer surface of the expanding cone, so that the auxiliary head is held in place by virtue of friction.

* * * * *